United States Patent [19]

Randolph, Sr.

[11] 3,942,354

[45] Mar. 9, 1976

[54] DIE UNIT WITH QUICK CHANGE FEATURES

[75] Inventor: Allan E. Randolph, Sr., Kettering, Ohio

[73] Assignee: Dayton Progress Corporation, Dayton, Ohio

[22] Filed: Nov. 14, 1974

[21] Appl. No.: 523,814

[52] U.S. Cl. ..... 72/448; 72/351; 72/465; 72/470

[51] Int. Cl.[2] ..... B21J 13/00

[58] Field of Search ..... 72/446, 447, 448, 350, 72/351, 362, 465, 470, 295, 296; 83/549, 571, 108, 143, 145, 146, 467, 698; 113/1 F, 7 A

[56] References Cited

UNITED STATES PATENTS

| | | | |
|---|---|---|---|
| 1,453,652 | 5/1923 | Auble et al. | 72/349 |
| 2,739,557 | 3/1956 | Staubitz | 113/46 |
| 2,974,967 | 3/1961 | Felmet | 83/698 |
| 2,996,025 | 8/1961 | Georgeff | 83/698 |
| 3,495,495 | 2/1970 | Berry | 83/698 |
| 3,610,021 | 10/1971 | Hopper | 83/698 |
| 3,665,795 | 5/1972 | Mayer | 83/467 |
| 3,673,908 | 7/1972 | Smith | 72/446 |
| 3,748,941 | 7/1973 | Richards | 83/698 |
| 3,834,217 | 9/1974 | Ducate | 72/446 |

*Primary Examiner*—C. W. Lanham
*Assistant Examiner*—James R. Duzan
*Attorney, Agent, or Firm*—Jerome P. Bloom

[57] ABSTRACT

A die system wherein upper and lower die shoes have a basic generally standardized form and are adapted for an interchangeable mount of various sub-assemblies embodying different die tools. The system features means facilitating a precise and quick location of a sub-assembly on its related die shoe as well as a quick release thereof. The invention further provides a unique pressure cell for backing the material being worked in a manner to insure optimal performance of the die and a quality work product.

26 Claims, 6 Drawing Figures

DIE UNIT WITH QUICK CHANGE FEATURES

BACKGROUND OF THE INVENTION

This invention relates to an improved die system embodying means facilitating precise location and quick interchange of die tools in a working press. It also provides means for improving the working performance of die tools. These and other features of the invention will become self-evident from the disclosures herein of preferred embodiments.

A continuing problem in the production of machine parts is the ever-increasing cost of material and labor. This problem is often compounded by the lack of knowledge or skill on the part of a machine operator. For example, if a press operator is not adept or lacks experience, the mounting and locating or interchange of the components of a die system can be a lengthy and not always accurate procedure. Even where an operator is adept and experienced, the prior art die systems with which he has to deal oftentimes do not facilitate a rapid interchange or precise location of die parts. In most instances a die system must be carefully and completely disassembled and reassembled in order to change the press from one operation to another. It is for this reason that, in general, set up and replacement time is costly and materially affects the output from a given press in a given period of time. Further, if the mounting of the die tools and the location thereof is not precise, it will result in poor and unacceptable work products.

A primary object of the invention is the solution of problems such as here noted and to provide an improved die system featuring means enabling unskilled press operators to quickly and accurately position and interchange die tools. A further object of the invention is to provide an improved back up means for material worked in a press which facilitate an economical handling of the material and the production of quality work products.

A further object of the invention is to provide an improved die system for use in a press including upper and lower die shoes which are basically of the same configuration and each arranged to similarly and releasably mount, in an improved manner, a variety of sub-assemblies which embody different die tools. In preferred embodiments the sub-assemblies are precisely and accurately positioned on the related die shoes by snap fit locator means which can be simply and quickly applied.

A further object of the invention is to provide an improved die system wherein the lower die shoe is formed with an opening nesting a multi-apertured carrier plate from which is suspended a pressure cell including a spring biased platform serving as a base of pins which project through apertures in the carrier plate and support, in elevated spaced relation to said plate, a pressure plate defining a platform on which material may be worked by an opposing die tool or tools.

Another object of the invention is to provide means for improving the production capacity of a press and the quality of its work products.

An additional object of the invention is to provide an improved die system wherein the die halves are comprised of generally standardized die shoes to which a variety of sub-assemblies embodying die tools may be slip fit and, in the process thereof, precisely located.

A further object of the invention is to provide a unique positioning device for use in locating die tools on a backing plate.

An additional object of the invention is to provide an improved pressure cell for use in a die.

An additional object of the invention is to provide an improved die system and components thereof possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein some but not necessarily all the various embodiments of the invention are illustrated, FIG. 1 is a view, primarily in vertical section, of a blanking die in accordance with the invention;

Figure 1:
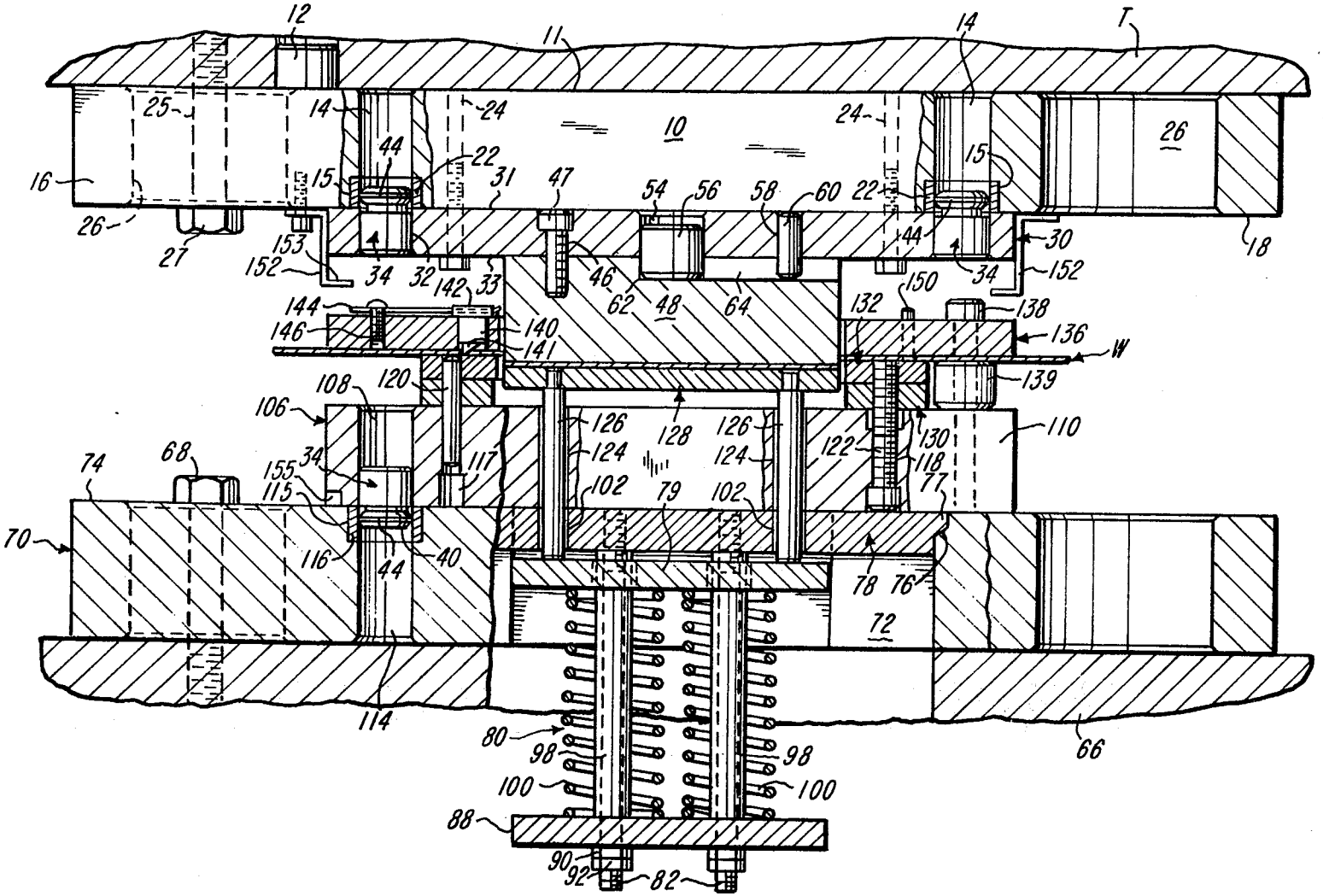

An embodiment of the invention which may be used for punching, cutting and/or blanking is illustrated in FIG. 1 of the drawings. With reference to the orientation of parts as there shown, an upper die shoe adapted to be connected to a thrust plate T fixed in turn to the under side of the ram or slide of a press is in the form of a rectangular plate 10. Fixed to project from the upper surface 11 of the plate 10, in a line parallel to its forwardmost edge, are a pair of relatively spaced indexing pins 12 adapted to seat in mating recesses in the thrust plate T.

The plate 10 is bored to provide it with various apertures including a pair of spaced apertures 14 which also are of a uniform diameter and arranged in a line parallel to its front edge 16. As here used, the term "front" denotes the edge of the plate 10 which will dispose to the front of a press, in its installed position. The apertures 14 are counterbored at 15, in a sense inwardly of the plate surface 18 which is lowermost as the plate 10 is assembled to the thrust plate T. Press fit or otherwise secured in each counterbore 15 is a ring shaped bushing 22 formed, preferably, of hardened steel. The plate 10 is provided, also, with a series of small diameter apertures 24 the wall surfaces of which are tapped in a direction inwardly from the surface 18 to form therein a thread. Adjacent each of the three corners thereof, the plate 10 has a relatively large diameter aperture 26 arranged to be conventionally rimmed by a conventionally mounted dependent guide bushing of tubular configuration. Additional apertures 25 provide for the application of cap screws 27 to suitably secure the plate 10 to the thrust plate T, and thereby to the press slide.

Fixed to and centered on the surface 18 of the die shoe 10 is a punch sub-plate 30. The plate 30 has formed therein a pair of apertures 32 which align with and have the same diameter as the apertures 14 in the plate 10.

In accordance with the invention the sub-plate 30 and the die apparatus which mounts in a dependent relation thereto provides a sub-assembly forming a package which is first located on the plate 10 by means of snap fit plug devices 34.

Each plug device 34 is comprised of a cylindrically formed body section 36 sized to be press fit in and to substantially fill the depth of an aperture 32 and is thereby secured to the plate 30 prior to the application thereof to the plate 10. Integral with and forming an axial extension of one end of the body segment 36 is a relatively short, reduced diameter neck portion 38 the projected end of which is continued by an integrated radially expanded head portion 40 having the general shape of a flattened ellipse. The configuration of the head portion 40 provides it with spaced parallel portions 42 at its axial limits. The portions 42 have a generally circular configuration at their outer peripheries and the diameters thereof are substantially equal. One portion 42 joins to the projected end of the neck 38 and the other defines the projected end of the plug 34. Between the outer peripheral edges of the portions 42, in an axial sense, the peripheral surface of the head portion 40 is diametrally and generally uniformly expanded from each portion 42 to a plane generally centered between said portions 42 and positioned parallel thereto. Centered between the portions 42 in a sense axially of the plug 34, the generally arcuate peripheral surface of the head portion is provided with a narrow circumferential flat or land 44. The diameter of the land 44 is such to provide that through the medium thereof the head portion 40 may be inserted to achieve a friction fit with the inner wall of the bushing 22. More particularly, as seen in axial section, the configuration of the outer surface of the head portion 40 of a plug 34 is generally that of a uniform arc the apex of which is flatted to produce on the head portion the narrow peripheral land 44 affording a limited gripping surface dimensioned for frictional contact with the inner surface of a bushing 22.

As thus provided, the head portions 40 of the plugs 34 project from and perpendicular to the uppermost surface 31 of the plate 30, in a line adjacent and in a parallel relation to its forwardmost edge. For a quick and precise location of the plate 30 on the plate 10 the projected head portions 40 snap fit in bushings 22 in a manner to be further described.

The plate 30 has further apertures 46, each counterbored at the end thereof which opens from its surface 31 which, in the assembly thereof, is abutted to the surface 18 of the plate 10. Prior to its assembly to the plate 10 a punch or blanking tool 48 is fixed, by cap screws 47, to project from and perpendicular to the surface 33 of the plate 30 which is remote from and parallel to its surface 31. As may be seen in FIG. 1, the cap screws are thrust through the apertures 46 to have their head portions seat and nest in the counter-bored portions thereof as projected portions of the screws are threadedly engaged in the body of the tool 48.

Formed in the sub-plate 30 is a central, large diameter, aperture 54 in which is press fit one end of a hollow tubular dowel member 56. As thus applied, a portion of the tubular dowel 56 will project from and perpendicular to the surface 33. In line with and spaced radially outward from the aperture 54 the plate 30 has a further aperture 58 in which is press fit one end of a dowel pin 60. The opposite end of pin 60 projects from and perpendicular to the surface 33, to the same extent as the dowel 56.

A central recess forms a pocket 62 in the surface of the punch unit 48 adapted to abut the surface 33 of the sub-plate 30. In the assembly of the punch unit the pocket 62 receives therein the projected end of the dowel 56. Opening at one end to and extending radially from the pocket 62, in the surface of the punch unit which abuts the plate 30, is a radial recess or groove 64, the projected end of which opens from a side portion of the punch 48. In the assembly of the punch 48 to the sub-plate 30, the pocket 62 receives the projected end of the dowel member 56 and at the same time the groove or recess 64 is positioned to receive the projected end of the dowel member 60. This association of parts enables, in a simple manner, a quick, precise and accurate location of the punch unit in reference to the plate 30, prior to the application of the screws 47 and the sub-assembly thus provided to the plate 10.

As will be self-evident, the hollow dowel 56 and the pin 62 provide for X-Y and radial control of the location and orientation of the punch unit 48.

The foregoing description refers to the upper half of the die assembly shown in FIG. 1. Fixed to the press bed, either directly or through the medium of an interposed bolster 66, is a lower die shoe 70 having a rectangular plate form. The plate 70 is similar in configuration to the plate 10 and has a group of similarly positioned apertures including a plurality accommodating cap screws 68, by means of which it is fixed in a vertically aligned relation to the upper die shoe after being precisely located by means similar to that described with reference to the plate 10. The plate 70 differs from the plate 10, however, in that it has a large central opening 72 in the form of a cross.

As seen in FIG. 1, the respectively opposite end wall portions of each of the right angled sections of the cross shaped opening 72 are offset or stepped to define, adjacent the upper surface 74 of the plate 70, a pair of longitudinally spaced, angularly sloped, upwardly and outwardly divergent shoulders 76. The shoulders 76 provide seats for complementarily shaped projections 77 to either end of a multi-apertured carrier plate 78. So mounted, the plate 78 bridges one of the right-angled sections of the cross-shaped opening 72 and its upper surface is disposed thereby in the plane of the surface 74.

The carrier 78 provides the anchor element of a pressure cell 80 and mounts, in dependent relation thereto, four rectangularly positioned, perpendicularly projected, studs 82. Below the carrier 78, the studs 82 project first through apertures in a plate 79 and then through apertures in a further plate 88. The lowermost end portion of each stud is threadedly engaged by a nut 90 and a jamb nut 92. As shown in the drawings, these nuts provide a base for the plate 88. Each stud is surrounded by a sleeve 98 which projects through the plate 79 to abut, at one end thereof, the carrier plate 78 and at the other end the plate 88. The relative position of plates 78 and 88 is thereby fixed. Wrapped about each sleeve and contained between the plates 88 and 79 is a coil-type compression spring 100. Since the springs 100 are firmly based on the plate 88, they apply a bias to urge the plate 79 into engagement with the under surface of the carrier plate 78. The carrier plate 78 includes further apertures 102 the purpose of which will soon be obvious.

A generally rectangular plate 106, which may be designated as a lower sub-plate, mounts in a superposed abutted relation to the surface 74 of plate 70. Plate 106 includes apertures 108, arranged in a line parallel to its front edge 110. Apertures 108 are of uniform diameter equal in dimension to the diameter of the apertures 14. To fix the location of plate 106 on the lower die shoe 70, apertures 108 must be in alignment with its apertures 114. Each aperture 114 is counterbored at 115, in a sense inwardly of the shoe surface 74. Press fit in each counterbore 115 is a ring-shaped steel bushing 116 identical in form and nature to the bushing 22 previously described. Prior to the mount of the plate 106, and the die tools which are previously connected, each aperture 108 has press fit therein the segment 36 of a locator plug 34, such as previously described, to have its neck and head portions relatively project from the under surface of the plate. The head portions 42 of the plugs 34 in connection with the plate 106 are adapted to be snap fit in the bushings 115 to thereby precisely locate the plate 106 and attached die components on the plate 70, in the same manner as they function in the location of the plate 30 on the plate 10.

Plate 106 is provided with further apertures 117 in which are press fit dowel pins 120, the uppermost portions of which project from and perpendicular to the uppermost surface of the plate, as seen in FIG. 1. Additional apertures 118 in plate 106 are counterbored to accommodate the heads of cap screws 122 the threaded bodies of which can project upwardly to extend outwardly from and perpendicular to the uppermost surface of plate 106 to the same degree as dowel pins 120. The plate 106 further includes, centrally thereof, a series of apertures 124 which in assembly of the plate to the lower die shoe 70 will vertically and axially align with the apertures 102 in the carrier plate 78. The apertures 124 provide guide passages which are adapted to receive therein pressure pins 126 the lower ends of which project through aligned apertures 102 to seat in a free bearing relation to an imperforate area of the upper surface of the plate 79. The upper ends of the pins 126 are fixedly connected to the body of a pressure plate 128. The springs 100 serve, through the medium of their seat on the plate 88 and their engagement with the plate 79, to maintain a bias on the pins 126 to the extent the upper surface of the plate 128 is established in what may be considered the working station of the described die. In peripherally surrounding relation to the upper ends of the pins 126 and seated in superposed relation to the upper surface of plate 106 is a frame-shaped rectangular filler plate 130. Superposed on the plate 130 and of generally similar outline is a die plate 132, the inner peripheral edge of which circumscribes a lesser area than that circumscribed by the inner peripheral edge of the filler plate 130. It is noted that the inner peripheral edge of the frame-shaped die plate 132 is a cutting edge which positions in closely spaced relation to the adjacent edge of the pressure plate 128. While there is a closely spaced relation, the clearance between the pressure plate and the cutting die 132 is sufficient to enable the pressure plate 128 to move to and from an uppermost biased position in which its uppermost surface is coplanar with the uppermost surface of the die element 132.

The plates 130 and 132 have apertures which in the mounting thereof on the plate 106 are aligned and accommodate a press fit of the dowel pins 120 on the one hand and the threaded engagement thereof by the cap screws 122 on the other hand. In any case, prior to assembly of the plate 106 to the lower die shoe 70, the elements 130 and 132 are suitably fixed, as described, to the uppermost surface of the plate 106. Further comprised in this sub-assembly to be mounted as a package or unit on the upper surface of the die shoe 70 is a stripper plate 136. The plate 136 is supported in a fixed, spaced, relatively elevated relation to the plate 106 and in adjacent relatively elevated relation to the upper surface of the die element 132 by means of cap screws 138 the bodies of which are surrounded, between the plate 136 and the upper surface of the plate 106, by tubular spacers 139.

The supports so provided for the stripper plate 136 are positioned clear of the working area of the die so as to enable strip or sheet material to be fed through the die, from right to left as seen in FIG. 1 of the drawings. In the course of a feeding operation the strip or sheet material will be advanced to position over the uppermost surface of the pressure plate 128 and the surrounding die 132. In the instance illustrated, immediately beyond the working station so provided, the stripper plate 136 has an aperture through which is thrust the cylindrically formed body portion of a stop member 140. The member 140 includes a radially expanded head 142, the uppermost surface of which has a diametral slot, and the peripherally projected portion of which is adapted to seat to the upper surface of the stripper plate. Nested in the diametral slot is one end of a leaf spring 144 the opposite end of which is anchored by a screw 146 to the stripper plate 136. Under the influence of the spring 144 the stop member 140 is biased to have a triangular projection 141 on the lower end thereof extend through an opening in the material being fed to determine a limit for its movement, which prevents a retracting of the material from the working station and establishes the same in a proper position for a cutting operation. It will be obvious, of course, that the material being worked will have a series of spaced apertures adapted, in the stepped movement of the material to the working station, to receive the projection at the lower end of the stop member 140. It should be observed that in the case illustrated the projection 141 has a triangular configuration wherein the following surface is vertical to form a stop and the leading surface is inclined downwardly and forwardly to its apex to facilitate the forward movement of material from the working station, as and when required. Within the general area of the working station, the material will be laterally contained by guide pins 150 mounted to and projected upwardly from the plate 132.

FIG. 1 of the drawings illustrates the upper die half in a closed position wherein the tool 48, assisted by the cutting edge of the die 132, has completed a blanking stroke to separate a portion of the strip material within the working area of the die defined in part by the upper surface of the pressure plate 128. Due to the balanced nature of the bias applied to the pins 126 through the medium of the plate 79 during the blanking operation, the plate 128 will firmly maintain the material being blanked in a flat condition and against the working face of the tool 48. Moreover, in the closing stroke of the tool 48 the springs 100 will react to divide the force applied and dissipate the same without any serious consequence to the die structure. Further, as the die opens, the pressure plate 128 will be under a bias which brings the blanked segment of material back into the line of movement of the remainder of the material to be advanced in a further feeding operation. Thus, as the strip material is advanced to bring the next section thereof into the working station, it will move the blanked portion of the material ahead of it and discharge it from the die. This eliminates need for special attachments to remove the blanked portions of the material from the press. The advantages are believed obvious, and derive from the unique construction and disposition of the pressure cell as here provided.

It will be seen from the foregoing description that the invention provides additional features of novelty such as unique means to locate and mount die tools on their sub-plates, namely the plates 30 and 106, and that the sub-assemblies achieved thereby may each be individually and quickly located on and applied as a unit to the appropriate die shoe.

The uniqueness and advantage of the locator plugs provided may be seen from the following. Referring to FIG. 1, to facilitate the application of the upper sub-assembly including the plate 30 and the punch 48 to the upper die shoe 10, a pair of hanger strips 152 are fixed to depend from the under surface of the plate 10 in laterally spaced parallel relation. At their dependent extremities, the strips 152 include horizontal leg portions 153 which are directed towards each other. As seen in FIG. 1, in the assembled relation of the upper die half, the hanger portions 153 are positioned below and in spaced relation to the lateral edges of the plate 30 to an extent greater than the projection of the head portions 40 of the locator plugs 34. In the assembly procedure, following the location of the plate 10 on and the connection thereof to the thrust plate T, the sub-assembly including the plate 30 and the blanking tool 48 will then be applied in the general orientation illustrated but to first have the lateral edges of the under surface of the plate 30 seat on the leg portions 153 of the hangers 152. As previously described, the locator devices in the form of the pair of plugs 34 are in a position to vertically project from the uppermost surface of the plate 30, adjacent its forward edge. At this point the head portions 40 of the locator devices are positioned generally in line with the openings defined by the tubular bushings 22. Take particular note of the fact that both the locator devices and the bushings which relate thereto are adjacent the front of the press to which the die is applied. On grasping the forwardmost edge of the plate 30 and rocking it about the rearmost edge of the plate which seats on the hanger portions 153, the head portions 40 of the locator devices will be tipped as they are brought into the bushings 22. The angularity of the head portions at this point will determine the fact that as the locator devices are moved up into the bushings the contact between the heads 40 and their related bushings will be limited to what in effect are two points which are diametrically opposite on the head portions 40. Due to the tipping of the head portions in this procedure the fore and aft dimensions of the head portions are reduced so as to facilitate an upward thrust thereof into the bushings. When this is effected, the back portion of the plate 30 will be lifted to bring the surface 31 thereof in flush abutting contact with the surface 18 of the upper die shoe. Using this procedure, one which can be quickly, simply and easily executed, the entire sub-assembly is precisely located. As the back portion of the plate is tipped up into flush abutting contact together with the front portion, the fore and aft dimension of the head portions 40 of the locator devices are enlarged in their presentation to the bushings 22 to the point where they will come into full peripheral contact with the inner wall of the related bushings. The rotary movement involved with respect to the head portions 40 is such that there is a snap action thereof in moving to an axially aligned position with reference to their related bushings. In this manner the head portions 40 will in each instance be thereby established in a frictional gripping relation to the bushings in which they nest.

The orientation of the lower die shoe 70 is, of course, such that the sub-assembly embodying the plate 106 requires no particular guide or hanger devices. In this instance the plate 106 embodying its related die tool and projected locator devices is simply tipped and rocked to similarly achieve a nested relation of the head portions 40 in the bushings 116. The manner in which this is effected is believed quite obvious from the foregoing description.

In any case, the sub-assembly may be applied as an integrated unit and precisely located in a simple and effective fashion requiring no special adeptness or capabilities on the part of a press operator. Once the sub-assemblies are located it is a simple matter of applying three screws to fix them in place. The same three screws may be removed and the sub-assemblies tipped out reversely of the manner in which they have been inserted. To facilitate a lifting of the lower sub-assembly including the plate 106, the invention contemplates the use of notches 155 provided in the peripheral edges of its seating surface. A lever device may be applied to such a notch or notches to facilitate a tipping of the plate 106 to rotate the heads of the locator devices so they may be readily slipped from the bushings in which they nest.

In summary, with reference to the showing in FIG. 1, there has been illustrated not only a unique and a very effective pressure cell having advantageous functions but also a very simple and effective use of dowel means to quickly position a die tool on a backing structure, as well as a new concept to simplify the location and application or interchange of a sub-assembly embodying the die tools without need for handling the related die shoe.

Not to be overlooked is the simple biasing structure provided for the stop member 140. Of course, the basic arrangement of the die shoes facilitates the ease and the rapidity with which a die may be assembled or removed.

Figures 2, 6:
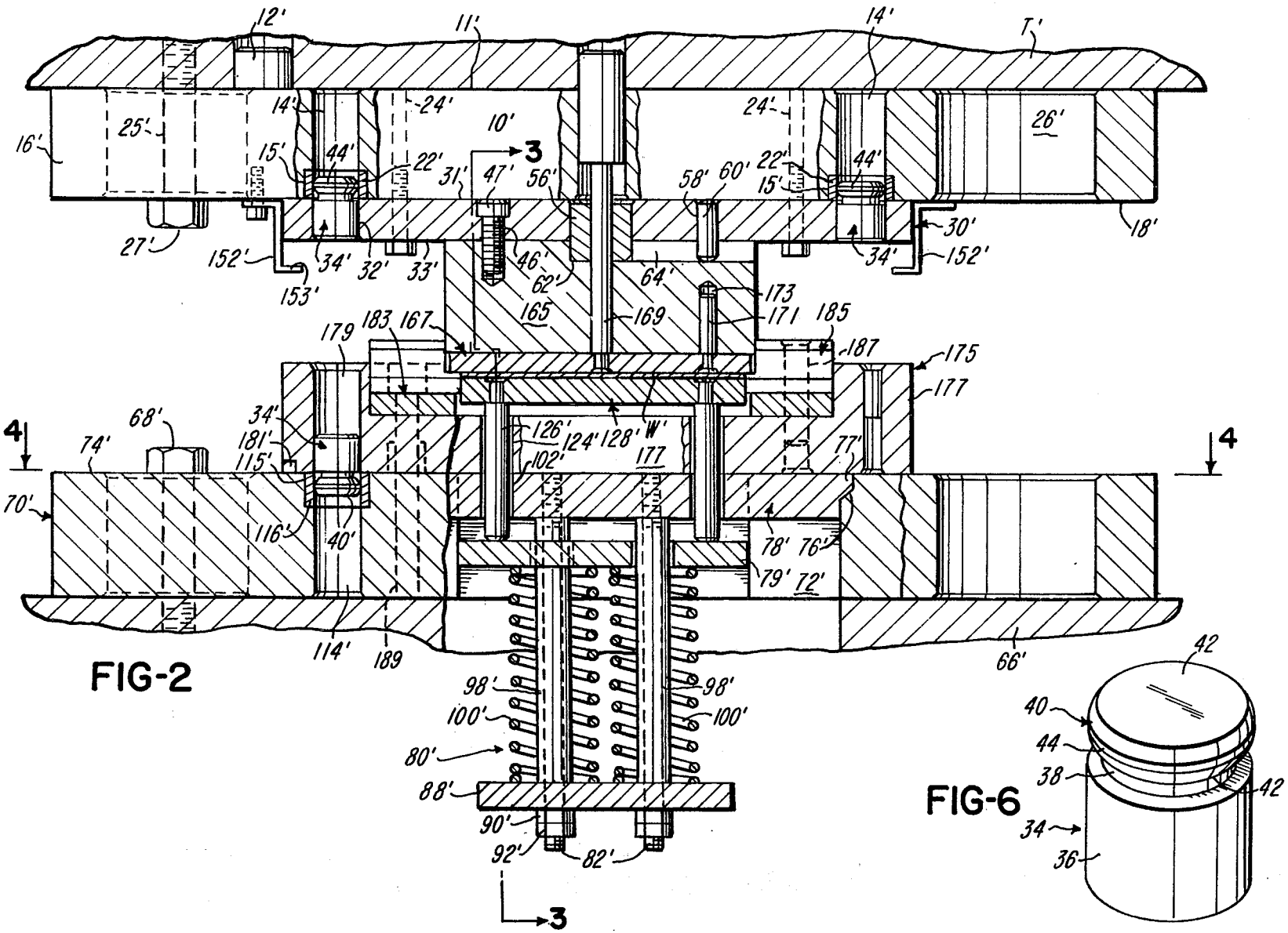
FIG. 2 is a view generally similar to that of FIG. 1 of a forming die in accordance with the invention.
FIG. 6 is an enlarged view of the locator pin of the present invention.
Figure 3:
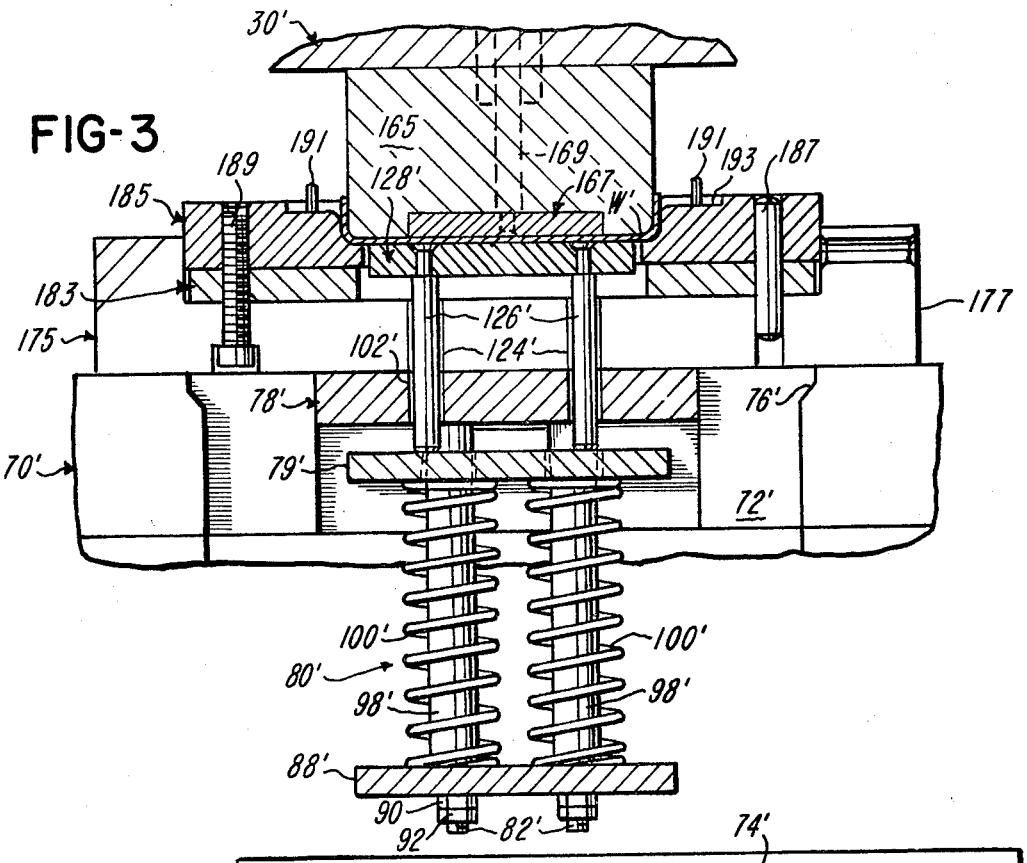
FIG. 3 is a view taken on line 3—3 of FIG. 2.

FIGS. 2 and 3 of the drawings show a forming die constituting a modification of the invention shown in FIG. 1. In this embodiment of the invention most components are identical with those illustrated and described with reference to FIG. 1. As to such components, they will be identified by like numerals, differing only by reason of the application of a "prime" (′) symbol.

Referring to the upper die half here illustrated, the sub-assembly releasably connected to the upper die shoe in the form of a rectangular plate 10′ includes the sub-plate 30′ which embodies, in connection therewith, locator plugs 34′, a tubular dowel 56′ and a dowel 60′. As in the instance first described, the dowels 56′ and 60′ respectively seat in a pocket 62′ and a groove 64′ extending radially therefrom in the abutted surface of the forming tool 165. Moreover, the forming tool 165, once so positioned in abutment with the under surface of the plate 30', is connected to this plate by cap screws 47'. Thus the forming tool 165 embodies the simple, accurate and quick locating and positioning structure of the tool 48. The difference in the forming tool 165 here illustrated is a longitudinal groove in its working surface, which groove is filled by a knockoff plate 167. Fixedly connected to the plate 167 is a knockout rod 169 which extends perpendicular thereto, through a central aperture in the forming tool 165 and the dowel 56' to have its uppermost enlarged head end position in a central aperture provided in this instance in the plate 10'.

In the case of the sub-assembly comprising the plate 30', the forming tool 165 and associated structure, once the die shoe 10' is fixed in place, the sub-assembly may be fixed in place in the manner of the sub-assembly of the upper die half of FIG. 1.

Of course, other than its central aperture, plate 10' is identical to the upper die shoe utilized in the embodiment of FIG. 1.

Attention is directed to the fact that in addition to the knockout plate 167 being suspended by the control rod 169, there is also connected to the plate 167 a guide pin 171. The pin 171 bears in a passage 173 provided in the body of the tool 165 in a line parallel to the rod 167. This insures that in the course of any vertical movement of the knockout plate that it will be guided to and from its appropriate nested relation to the forming tool without any incidence of misalignment.

Referring now to the lower die half of FIGS. 2 and 3, the lower die shoe and the pressure cell associated therewith is identical in all respects with the lower die shoe and the pressure cell described with reference to the structure of FIG. 1. Therefore, in this instance also their elements will be identified by like numerals, distinguished only by "prime" (') symbols.

Accordingly, in this case the plate 70' constituting a lower die shoe is first mounted on and fixed to the press bed through a medium as previously described. Following this, the carrier plate 78' and the associated pressure cell structure may be set in place. The lower sub-assembly is then located and mounted on the lower die shoe using the features previously described with reference to FIG. 1.

Specifically the lower sub-assembly comprises a sub-plate 175 the base of which is adapted to seat to the upper surface 74' of the plate 70'. The surface of the plate 175 which disposes uppermost has a rectangular recess, giving it a cup-like shape. Formed in the peripheral wall of the cup-shaped plate 175, at spaced locations in a line adjacent and parallel to its forwardmost edge 177, are apertures 179. Each aperture 179 has press fit in the lower or base oriented portion thereof the body segment 36' of a plug 34'. As so mounted, the head portions 40' of the plugs 34' will project from the under surface of plate 175. It will be seen that the apertures 179 mounting the plugs 34' are arranged in the plate 175 so that they will superpose and vertically align with the apertures 114' in the plate 70'. This will enable that in a tilting movement of the sub-assembly including the plate 175 that the projected head portions 40' of the plugs 34' may be easily inserted in or removed from bushings 116' in the counterbored upper ends of the apertures 114'. The initial, limited, diametrally opposite point contact of the flats 44' on the head portions 40' of the plugs, effected by reason of a tilting of the plate 175 for their initial entry to the bushings, will facilitate the achievement of a quick and precise location of the plate 175 on the lower die shoe as the plate 175 is brought to a firmly seated position.

It will be thus seen that the sub-assembly to be achieved with the plate 175 as the base may be quickly, precisely and effectively located. Viewing FIG. 2, it will be also seen that the seating edge is provided with a peripheral notch or notches 181' which can facilitate the displacement of the sub-assembly from the lower die shoe very quickly, once the connecting cap screws are released.

Returning to the description of the lower sub-assembly, nested in the cup-shaped recess of the plate 175, and seating to the base thereof, is a frame shaped filler plate 183 on which is superposed a frame shaped forming plate 185. The elements 183 and 185 are both of rectangular shape and suitably connected to the base of the plate 175 by positioning dowels 187 and cap screws 189. It is believed that the arrangement provided in this respect will be clear from FIGS. 2 and 3 of the drawings.

The configuration of the rails of the forming plate 185 is clearly evident from FIG. 3 of the drawings. As shown, it provides that a plate-like part W' to be formed may be laid on recessed upper surface portions 193 at the inner edges of the opposite rails to be laterally contained by raised shoulder portions at their outer edges and positioned in abutment with stop pins 191 to one end. In the open position of the forming die the pressure plate 128' will normally position with its uppermost surface co-planar with the rail surface portions 193 and define therewith the working area of the die. In a fashion as described with reference to the pressure cell of FIG. 1, the pins 126' in connection with and in dependent relation to the plate 128' will project through apertures in the carrier plate 78' to bear on floating platform 79'. The bias of the springs 100' will consequently maintain the pressure plate 128' in a balanced condition and against the workpiece W' between the forming rails throughout the working stroke of the tool 165.

More specifically, as seen in FIGS. 2 and 3, in the forming operation the pressure plate will be depressed against the balanced spring pressure imposed thereon by the pressure cell but will in all cases maintain the flatness of the workpiece portion against which it bears. When the upper half of the die moves upwardly to an open position, the bias of the pressure cell will return the pressure plate 128' to its working station, ready to similarly function on the next stroke of the die. The cell 80' functions to insure optimal quality of the work product.

The knockout plate will be used in a conventional manner, well known to those versed in the art.

Figure 4:
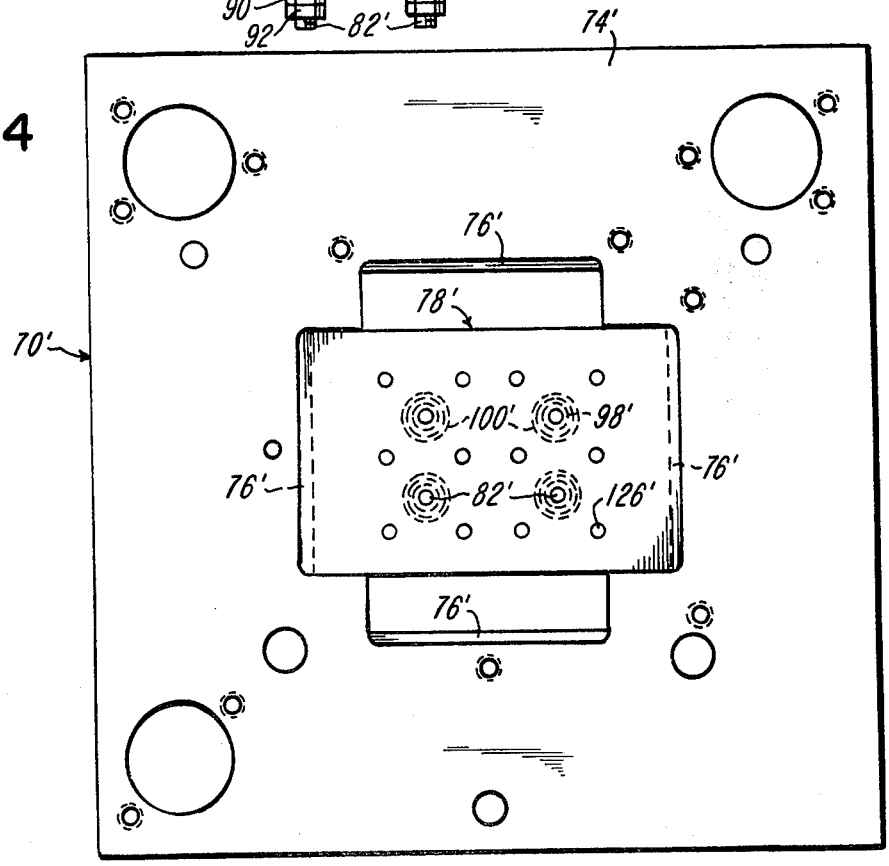
FIG. 4 is a view taken on line 4—4 of FIG. 2.
Figure 5:
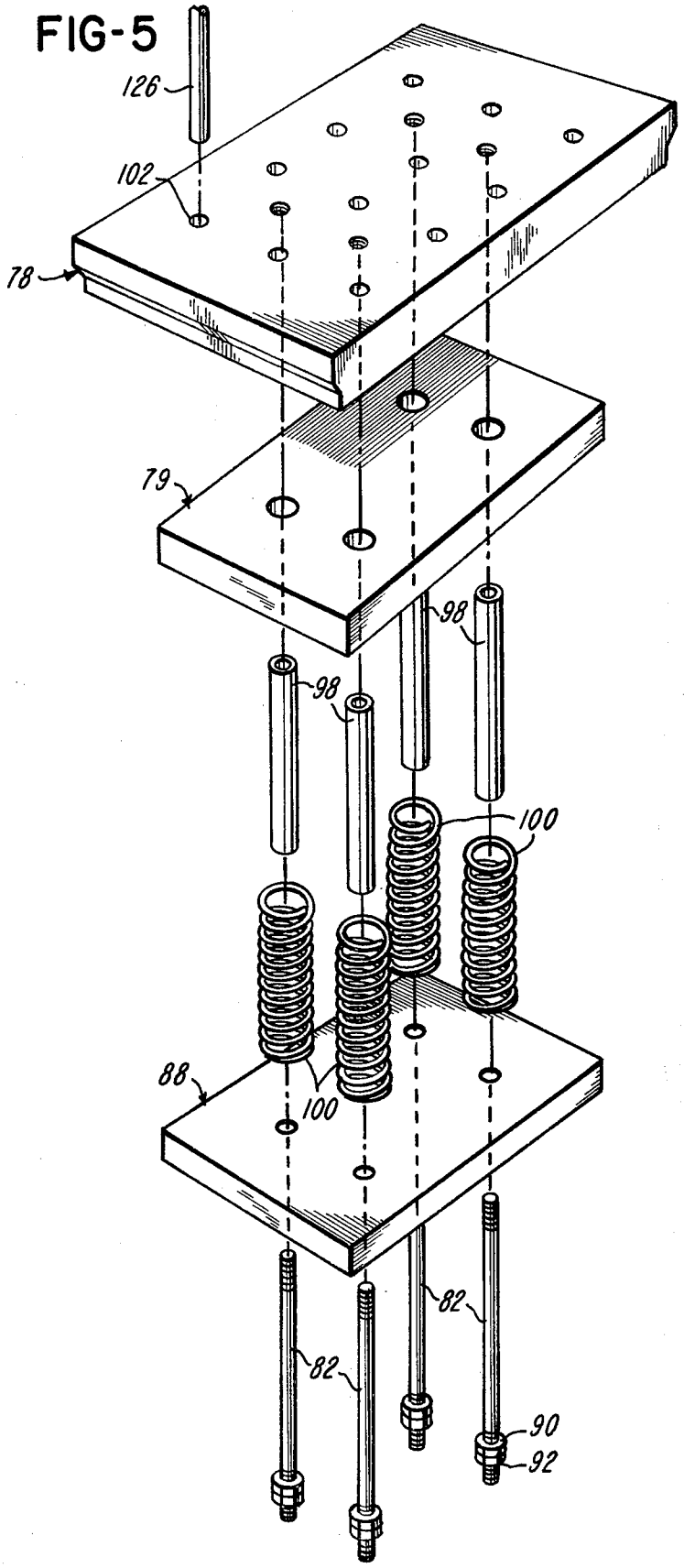
FIG. 5 is an exploded view illustrating the details of the pressure cell of the embodiments of FIGS. 1–4, as related to the lower die shoe therein.

FIG. 4 of the drawings is included to show the basically simple nature of the lower die shoe utilized in each of the preferred embodiments described. This figure features a plan view of the cross shaped opening 72' and the application thereto of the carrier plate 78' which may be optionally disposed in the cross shaped opening at right angles to the position illustrated. It should be noted that the lower die shoe afforded by the plate 70 or 70', as the case may be, will include in each case a large diameter aperture at each of three corners thereof which are adapted to vertically align with the large diameter apertures 26 or 26' similarly provided in the upper die shoe associated therewith. These large apertures at three corners of the lower die shoe each define a location for mount of a vertically projected guide post to telescopically nest in the conventional bushing which is attached to the upper die shoe, in engagement therewith, and to provide means for maintaining a vertical guided relation of the upper die shoe with reference to the lower die shoe in the press in which they are embodied. Such details are conventional and therefore not further described.

From the foregoing, the advantages in use of the invention features are believed obvious. For example, the use of the locator plugs as described not only simplifies and speeds the location, application and removal of a sub-assembly but in the snap fit application of the head portions of the plugs there is achieved, in effect, a line contact thereof with the bushings in which they are inserted. This guarantees a precision location of parts. The same applies to the invention concept of positioning a die tool, such as 48 or 165 as described, in reference to a back up or sub-plate. The provision of the pocket 62 as well as a radial groove 64 to simultaneously accommodate a central and a radially displaced locating dowel lends precision and speed to the application of the tool. Thus, there is an ease in the relative positioning of parts in all respects.

Further, the use of a pressure cell and pressure plate in the arrangement provided by the invention offers a control of the material worked in the die so that the product of the die operation has an optimal quality.

Thus, not only have the problems first noted been solved by the improvements of the present invention but there has been created an improved die system which can be utilized by people less than skilled in the art without particular problem.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications with the legitimate and valid scope of the appended claims.

The embodiments of the invention in which an exclusive property or privilege is claimed are defined as follows:

1. For use in a die system, a die half including a die shoe having a through opening, means peripherally of the opening being configured to support a carrier plate, a carrier plate received in said opening, a sub-plate superposing on said die shoe and confining said carrier plate in said opening, a pressure plate overlying said sub-plate and reciprocable relative thereto, means on said sub-plate in a generally surrounding relation to said pressure plate and defining a die sperture, a pressure cell suspended from said carrier plate and depending therefrom to position at least a portion thereof within said opening, said cell including a spring pressed platform located in an underlying relation to said carrier plate, and means based on said platform and extending through said carrier plate and said sub-plate into a supporting relation to said pressure plate.

2. A die half according to claim 1, wherein said die shoe opening is comprised of plural intersecting apertures each having peripheral configured portions by means of which said carrier plate may be selectively installed in said apertures.

3. A die half according to claim 1, characterized by means to position said pressure plate to cooperate with said means defining said die aperture in providing a supporting surface for a work piece.

4. A die half according to claim 3, characterized by a stripper plate mounted in an overlying relation to said sub-plate having an aperture aligned with said pressure plate and adapted to receive a penetrating die tool, said stripper plate being disposed in an adjacent spaced relation to said pressure plate.

5. A die half according to claim 4, characterized by detent means mounted to said stripper plate at least a portion of which is arranged to project therefrom into the path of a work piece advanced between said stripper plate and said means defining a die aperture to limit its movement in one direction and preclude a retrograde movement thereof.

6. A die half according to claim 4, characterized by means to position said stripper plate in a precisely determined spaced relation to said sub-plate.

7. A die half according to claim 1, characterized by means for quickly and precisely locating said sub-plate on said die shoe comprising cooperating means which in a relative angular disposition of said sub-plate and the die shoe present cooperating portions configured to slip fit and in a facing disposition of said sub-plate to the die shoe present cooperating portions of different configuration adapted to fix the sub-plate against movement in a sense laterally of said die shoe.

8. Apparatus as in claim 7 wherein said cooperating means include one portion presenting an internal wall surface and a second portion for nesting in said one portion presenting a male element the head of which presents different transverse dimensions in different positions, the dimension of which head presents essentially diametrically spaced point contacts therewith in an angular position referenced to said wall surface and extended peripheral frictional contact therewith on a relative axial alignment with the central axis of said internal wall surface.

9. A die half as in claim 1, characterized by means for quickly and precisely locating and mounting said sub-plate on said die shoe including means defining a plurality of cavities in one of said sub-plate or said die shoe and means defining mating projections from the other thereof configured and adapted in one relative position of the sub-plate and the die shoe to provide point contacts between each said projection and the wall of the related cavity and in a position wherein said sub-plate and said die shoe are superposed to provide a substantially coextensive peripheral contact of each said projection with the wall of its related cavity.

10. For use in a die system, a sub-assembly comprising a die tool and a backing means therefor, said die tool being adapted to be mounted in abutted relation to said backing means and means for precisely and quickly locating said die tool on said backing means including means defining a central recess in one of said tool or backing means and a mating dowel projecting from the other and means defining a groove in one of said tool or backing means which orients in a line radial to said central recess and its mating dowel and a projection defining a dowel on the other, a simultaneous alignment of said recess and groove with the respectively related dowels facilitating an immediate and direct slip fit of one to the other of said tool and backing means to precisely define the required position of said die tool on said backing means.

11. Apparatus as set forth in claim 10 characterized by one of said tool or backing means incorporating therein said central recess and said groove and the other thereof mounting said mating dowels.

12. A die system including the apparatus as set forth in claim 10 including a die shoe for positioning in a press in a backing relation to the backing means for said die tool, said backing means and said shoe having surfaces adapted to abut in the mounting of one to the other, one of said abutting surfaces including means defining at least one pair of projections and the other thereof including recesses adapted to receive and mate with said projections, and said projections being formed to present, on a relative angular disposition of the surfaces, a smaller peripheral dimension to said cavities than when the same are directly aligned whereby to facilitate the quick positioning of said die tool and its backup means on said die shoe by tilting of one thereof relative the other in introducing said projections in said cavities, and the relative configuration of said projections and the walls of said cavities providing a snap fit thereof upon a flush abutted relation of said backing means to said die shoe.

13. Apparatus particularly advantageous for use in connection with one element of a die for quickly and precisely locating said one element relative another element of the die including a body, a projecting end portion of which is adapted for application in a passage, cavity or recess in the other said element, said end portion having a form to present, upon a relative angular disposition of its central axis with reference to the wall defining said passage, cavity or recess, a peripheral configuration of its cross sectional outline providing for a slip fit entry thereof within the confines of said wall, and said end portion having a form to present, upon a change of said relative angular disposition of its central axis following said slip fit entry, a cross-sectional outline disposing transverse to said wall which provides for a substantial friction fit engagement thereof to said wall precluding its relative lateral movement.

14. Apparatus as in claim 13 wherein said end portion has an axial dimension less than its peripheral dimension and a substantially arcuate outline intermediate the ends thereof.

15. Apparatus as in claim 14 wherein a portion of said arcuate outline is flatted.

16. Apparatus as in claim 14 wherein said substantially arcuate outline is characterized by a circumferential flat defining the cross sectional portion of said end portion which is presented to the wall of the related passage, cavity or recess to achieve said friction fit engagement therewith.

17. Apparatus as in claim 16 wherein said body has a plug-like shape, the opposite end portion formed for a press fit connection in a passage, cavity, or recess in said one element and a necked portion separating said end portions.

18. Apparatus as in claim 17 wherein the cross sectional outline of said end portion presented for said slip fit entry provides for diametrally opposite points of contact with said wall.

19. Apparatus as in claim 13 for quickly and precisely locating a die plate or sub-assembly on a die shoe characterized by one of said die plate or shoe having in connection therewith a plurality of said bodies in spaced projected relation and the other thereof having a plurality of said passages, cavities or recesses to accommodate the same, a tilting of one of said die shoe or plate relative the other producing said slip fit entry of said projections as defined by said end portions of said bodies and on seating of one to the other said friction bearing engagement of said end portions to the related walls to preclude relative lateral movement of said shoe and the die structure which mounts thereon.

20. For use in a die system, a die half including a die shoe, a sub-plate separably applied to an outwardly facing surface of said die shoe and a die tool applied to an outwardly facing surface of said sub-plate, and means acting inherently in the application of said sub-plate to said die shoe precisely to locate said sub-plate and to prevent relative angular movements thereof and in the application of said die tool to said sub-plate precisely to locate said die tool and to prevent relative angular movements thereof.

21. A die half according to claim 20, wherein the means for locating said sub-plate includes plural plug devices, each having a shank portion fixed relative to one of said die shoe and sub-plate elements and a projecting head to be received in a recess in the other one of said die shoe and sub-plate elements, said head having an intermediate location of maximum diameter flatted to form a relatively narrow cylindrical band adapted to make a close intimate contact with the wall of said recess.

22. A die half according to claim 21, wherein the projecting head of each of said plug devices is formed on a uniform arc, the intermediate flatted location appearing at an apex portion of said arc.

23. A die half according to claim 20, wherein the means for locating said die tool includes means defining a central recess in one of said die tool and sub-plate elements and a mating dowel projecting from the other and means defining a groove in one of said die tool and sub-plate elements which orients in a line radial to said central recess and its mating dowel and a projection defining a dowel on the other, a simultaneous alignment of said recess and groove with the respectively related dowels facilitating an immediate and direct slip fit of one to the other of said die tool and sub-plate elements to precisely define the required position of said die tool on said sub-plate.

24. For use in a die system, snap action means precisely to locate a pair of superposing parallel plates relative to one another, including plural plug devices each having a projecting head, the projecting head of each having an intermediately positioning short length cylindrical portion from which the head decreases in diameter, said plug devices being installed in one of said plates and being adapted to have their projected heads received in recesses in the other of said plates, said projecting heads being introduced into said recesses in a two-phase snap action motion in a first of which said plates are held in a tilted relation to one another with decreased diameter portions of said heads entering said recesses and in a second of which said plates are brought into contacting parallel relation straightening said projected heads in said recesses and placing each said short length cylindrical surface in close bearing contact with a respective recess wall.

25. Snap action means according to claim 24, wherein the plate having the plug devices installed therein is in underlying relation to the plate having the recesses therein, characterized by means defining a rail means suspended from the overlying plate providing support for the underlying plate in its two-phase application to the overlying plate.

26. Snap action means according to claim 24, wherein each of said plug devices has longitudinally spaced apart cylindrical surfaces, an outer one of which is substantially shorter in length than an inner one, the cylindrical surface of shorter length being comprised in the projecting head the peripheral surface of which is formed on a uniform arc a narrow intermediate portion of which is flatted to define said cylindrical surface of shorter length, said one of said pair of plates having cylindrical recesses accommodating said plug devices with the cylindrical surfaces of greater length having a long bearing contact with the respective walls of said recesses in said one plate, the projecting head of a plug device being introduced at an angle into a respective recess in the said other of said plates and then tilted to place said cylindrical surface of shorter length into close bearing contact with the wall of said recess in the said other of said plates.

* * * * *

UNITED STATES PATENT AND TRADEMARK OFFICE

CERTIFICATE OF CORRECTION

PATENT NO. : 3,942,354

DATED : March 9, 1976

INVENTOR(S) : Allan E. Randolph, Sr.

It is certified that error appears in the above-identified patent and that said Letters Patent are hereby corrected as shown below:

Col. 1, line 55, "of" is corrected to read -- for --.

Col. 3, line 47, -- are -- is inserted following "40".

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,942,354 Dated March 9, 1976

Inventor(s) Allen E. Randolph

It is certified that error appears in the above-identified patent and that said Letters Patent are hereby corrected as shown below:

Column 11, line 61, "sperture" should read -- aperture --.

Signed and Sealed this

Twenty-first Day of September 1976

[SEAL]

*Attest:*

RUTH C. MASON
*Attesting Officer*

C. MARSHALL DANN
*Commissioner of Patents and Trademarks*